US008497821B2

(12) United States Patent
Cok

(10) Patent No.: US 8,497,821 B2
(45) Date of Patent: Jul. 30, 2013

(54) CHIPLET DISPLAY DEVICE WITH SERIAL CONTROL

(75) Inventor: Ronald S. Cok, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 1089 days.

(21) Appl. No.: 12/371,666

(22) Filed: Feb. 16, 2009

(65) Prior Publication Data

US 2010/0207848 A1 Aug. 19, 2010

(51) Int. Cl.
*G09G 3/30* (2006.01)

(52) U.S. Cl.
USPC ..... 345/76; 345/77; 345/78; 345/79; 345/80; 345/81; 345/82; 345/83; 345/84; 345/85; 345/86; 345/87; 345/88; 345/89; 345/90; 345/91; 345/92; 345/93; 345/94; 345/95; 345/96; 345/97; 345/98; 345/99; 345/100; 345/204; 377/64

(58) Field of Classification Search
USPC ..... 345/102, 76–100, 204–215; 377/64
See application file for complete search history.

(56) References Cited

U.S. PATENT DOCUMENTS

| | | | | |
|---|---|---|---|---|
| 4,368,467 | A | 1/1983 | Unotoro et al. | 340/799 |
| 4,769,292 | A | 9/1988 | Tang et al. | |
| 5,061,569 | A | 10/1991 | VanSlyke et al. | |
| 6,384,529 | B2 | 5/2002 | Tang et al. | |
| 6,919,681 | B2 | 7/2005 | Cok et al. | |
| 6,987,355 | B2 | 1/2006 | Cok | |
| 7,078,670 | B2 | 7/2006 | Atlas et al. | |
| 7,230,594 | B2 | 6/2007 | Miller et al. | |
| 2002/0003511 | A1 * | 1/2002 | Havel | 345/39 |
| 2002/0078559 | A1 * | 6/2002 | Buchwalter et al. | 29/832 |
| 2005/0017268 | A1 * | 1/2005 | Tsukamoto et al. | 257/200 |
| 2006/0055864 | A1 | 3/2006 | Matsumura et al. | |
| 2007/0057263 | A1 | 3/2007 | Kahen | |
| 2010/0039030 | A1 * | 2/2010 | Winters et al. | 313/505 |

FOREIGN PATENT DOCUMENTS

| | | |
|---|---|---|
| EP | 1 437 703 A1 | 7/2004 |
| JP | 2002-244576 | 8/2002 |

OTHER PUBLICATIONS

Yoon et al, A novel use of MEMS switches in driving AMOLED, Digest of Technical Papers of the Society for Information Display, 2008, 3.4, p. 13.

* cited by examiner

*Primary Examiner* — Joseph Haley
*Assistant Examiner* — Linh N Hoffner
(74) *Attorney, Agent, or Firm* — Global OLED Technology LLC

(57) ABSTRACT

A display device, including a substrate; an array of pixels arranged in rows and columns forming a light-emitting area over the substrate, each pixel including a first electrode, one or more layers of light-emitting material located over the first electrode, and a second electrode located over the one or more layers of light-emitting material; a first serial buss having a plurality of electrical conductors, each electrical conductor connecting one chiplet in a first set of chiplets to only one other chiplet in the first set in a serial connection, the chiplets being distributed over the substrate in the light-emitting area, each chiplet including one or more store-and-forward circuits for storing and transferring data connected to its corresponding electrical conductor; and a driver circuit in each chiplet for driving at least one pixel in response to data stored in the store-and-forward circuit.

19 Claims, 7 Drawing Sheets

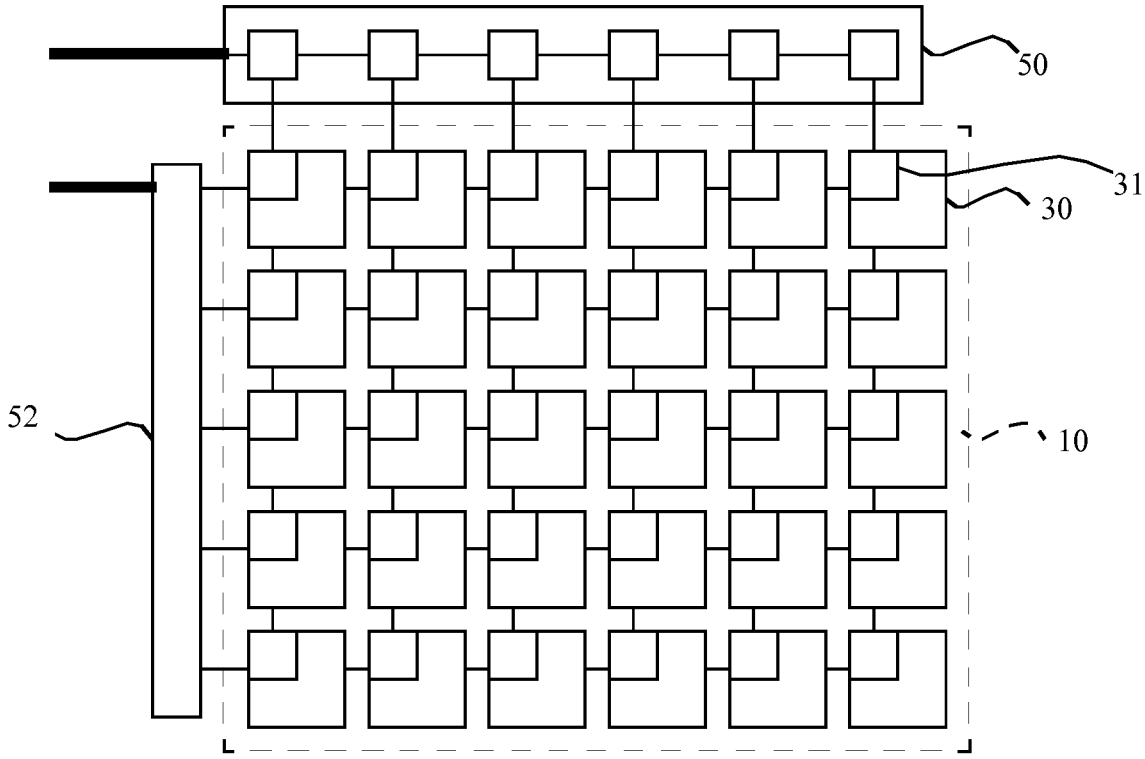
FIG. 8 - Prior Art

CHIPLET DISPLAY DEVICE WITH SERIAL CONTROL

FIELD OF THE INVENTION

The present invention relates to display devices having a substrate with distributed, independent chiplets employing serial control for a pixel array.

BACKGROUND OF THE INVENTION

Flat-panel display devices are widely used in conjunction with computing devices, in portable devices, and for entertainment devices such as televisions. Such displays typically employ a plurality of pixels distributed over a substrate to display images. Each pixel incorporates several, differently colored light-emitting elements commonly referred to as sub-pixels, typically emitting red, green, and blue light, to represent each image element. As used herein, pixels and sub-pixels are not distinguished and refer to a single light-emitting element. A variety of flat-panel display technologies are known, for example plasma displays, liquid crystal displays, and light-emitting diode (LED) displays.

Light emitting diodes (LEDs) incorporating thin films of light-emitting materials forming light-emitting elements have many advantages in a flat-panel display device and are useful in optical systems. U.S. Pat. No. 6,384,529 2 to Tang et al. shows an organic LED (OLED) color display that includes an array of organic LED light-emitting elements. Alternatively, inorganic materials can be employed and can include phosphorescent crystals or quantum dots in a polycrystalline semiconductor matrix. Other thin films of organic or inorganic materials can also be employed to control charge injection, transport, or blocking to the light-emitting-thin-film materials, and are known in the art. The materials are placed upon a substrate between electrodes, with an encapsulating cover layer or plate. Light is emitted from a pixel when current passes through the light-emitting material. The frequency of the emitted light is dependent on the nature of the material used. In such a display, light can be emitted through the substrate (a bottom emitter) or through the encapsulating cover (a top emitter), or both.

LED devices can include a patterned light-emissive layer wherein different materials are employed in the pattern to emit different colors of light when current passes through the materials. Alternatively, one can employ a single emissive layer, for example, a white-light emitter, together with color filters for forming a full-color display, as is taught in U.S. Pat. No. 6,987,355 e by Cok. It is also known to employ a white sub-pixel that does not include a color filter, for example, as taught in U.S. Pat. No. 6,919,681 by Cok et al. A design has been taught employing an unpatterned white emitter together with a four-color pixel including red, green, and blue color filters and sub-pixels and an unfiltered white sub-pixel to improve the efficiency of the device (see, e.g. U.S. Pat. No. 7,230,594 to Miller, et al).

Two different methods for controlling the pixels in a flat-panel display device are generally known: active-matrix control and passive-matrix control. In a passive-matrix device, the substrate does not include any active electronic elements (e.g. transistors). An array of row electrodes and an orthogonal array of column electrodes in a separate layer are formed over the substrate; the intersections between the row and column electrodes form the electrodes of a light-emitting diode. External driver chips then sequentially supply current to each row (or column) while the orthogonal column (or row) supplies a suitable voltage to illuminate each light-emitting diode in the row (or column). Therefore, a passive-matrix design employs 2n connections to produce $n^2$ separately controllable light-emitting elements. However, a passive-matrix drive device is limited in the number of rows (or columns) that can be included in the device since the sequential nature of the row (or column) driving creates flicker. If too many rows are included, the flicker can become perceptible. Typically, passive-matrix devices are limited to about 100 lines, far fewer than is found in contemporary large-panel displays, for example such as high-definition televisions that have over 1,000 lines and are therefore unsuitable for passive-matrix control. Moreover, the currents necessary to drive an entire row (or column) in a passive-matrix display can be problematic and limits the physical size of a passive-matrix display. Furthermore, the external row and column driver chips for both passive- and active-matrix displays are expensive.

Referring to prior-art FIG. 8, in an active-matrix device, active control elements 31 are formed of thin films of semiconductor material, for example amorphous or poly-crystalline silicon, coated over a flat-panel substrate 10. Typically, each sub-pixel 30 is controlled by one control element 31 and each control element 31 includes at least one transistor. For example, in a simple active-matrix organic light-emitting (OLED) display, each control element includes two transistors (a select transistor and a power transistor) and one capacitor for storing a charge specifying the luminance of the sub-pixel. Each light-emitting element typically employs an independent control electrode and an electrode electrically connected in common (together). Control of the light-emitting elements is typically provided through a data signal line, a select signal line, a power connection and a ground connection, for example by employing column driver 50 and row driver 52 integrated circuits.

Both the active-matrix and the passive-matrix control schemes rely on matrix addressing, the use of two control lines for each pixel element to select one or more pixels. This technique is used because other schemes such as direct addressing (for example as used in memory devices) require the use of address decoding circuitry that is very difficult to form on a conventional thin-film active-matrix backplane and impossible to form on a passive-matrix backplane. Another data communication scheme, for example used in CCD image sensors as taught in U.S. Pat. No. 7,078,670, employs a parallel data shift from one row of sensors to another row, and eventually to a serial shift register that is used to output the data from each sensor element. This arrangement requires interconnections between every row of sensors and an additional, high-speed serial shift register. Moreover, the logic required to support such data shifting would require so much space in a conventional thin-film transistor active-matrix backplane that the resolution of the device would be severely limited and is impossible in a passive-matrix backplane.

Active-matrix elements are not necessarily limited to displays and can be distributed over a substrate and employed in other applications requiring spatially distributed control. The same number of external control lines (except for power and ground) can be employed in an active-matrix device as in a passive-matrix device. However, in an active-matrix device, each light-emitting element has a separate driving connection from a control circuit and is active even when not selected for data deposition so that flicker is eliminated.

One common, prior-art method of forming active-matrix control elements typically deposits thin films of semiconductor materials, such as silicon, onto a glass substrate and then forms the semiconductor materials into transistors and capacitors through photolithographic processes. The thin-film silicon can be either amorphous or polycrystalline. Thin-film transistors (TFTs) made from amorphous or polycrystalline silicon are relatively large and have lower performance compared to conventional transistors made in crystalline silicon wafers. Moreover, such thin-film devices typically exhibit local or large-area non-uniformity across the glass substrate that results in non-uniformity in the electrical performance and visual appearance of displays employing such materials. In such active-matrix designs, each light-emitting element requires a separate connection to a driving circuit.

Passive-matrix devices are controlled by the sequential activation of, for example, row electrodes while electrodes connected to each column of pixels in an array are provided with respective analog data values. When the row electrode is activated, each column in the row of pixels is driven to a luminance corresponding to the data value on the associated column electrode. The process is sequentially repeated for each row in the pixel array. In an active-matrix device, a data value is likewise applied to every column electrode in an array and a select signal associated with a row activated to deposit the data values in a storage element associated with each pixel in the array. Again, the process is sequentially repeated for each row. An important distinguishing characteristic of the active-matrix devices is that the data values are stored with each pixel, thereby enabling the pixel to emit light even when the select signal for that pixel is inactive. In both passive- and active-matrix cases, signal lines form a two-dimensional matrix of vertical and horizontal wires, each driven by external drivers. The wiring for the signals takes up a considerable area on a substrate, thereby reducing the aperture ratio or increasing the number of metal layers on the substrate and the cost, and is limited in the frequency at which it can operate and the current that can be employed.

Employing an alternative control technique, Matsumura et al., in U.S. Patent Application Publication No. 2006/0055864, describe crystalline silicon substrates used for driving LCD displays. The application describes a method for selectively transferring and affixing pixel-control devices made from first semiconductor substrates onto a second planar display substrate. Wiring interconnections within the pixel-control device and connections from busses and control electrodes to the pixel-control device are shown. A matrix-addressing pixel control technique is taught and therefore suffers from the same limitations as noted above.

There is a need for an improved control method for display devices that overcomes the control and wiring problems noted above.

SUMMARY OF THE INVENTION

In accordance with the present invention, there is provided a display device, comprising:

(a) a substrate;

(b) an array of pixels arranged in rows and columns forming a light-emitting area over the substrate, each pixel including a first electrode, one or more layers of light-emitting material located over the first electrode, and a second electrode located over the one or more layers of light-emitting material;

(c) a first serial buss having a plurality of electrical conductors, each electrical conductor connecting one chiplet in a first set of chiplets to only one other chiplet in the first set in a serial connection, the chiplets being distributed over the substrate in the light-emitting area, each chiplet including one or more store-and-forward circuits for storing and transferring data connected to its corresponding electrical conductor; and (d) a driver circuit in each chiplet for driving at least one pixel in response to data stored in the store-and-forward circuit.

The present invention has the advantage of a simpler control method for a display. A further advantage is that the aperture ratio, and therefore the lifetime and power consumption, are improved compared to the prior art.

BRIEF DESCRIPTION OF THE DRAWINGS

FIG. 8 is a prior-art schematic of an active-matrix display device; and

Figure 1:
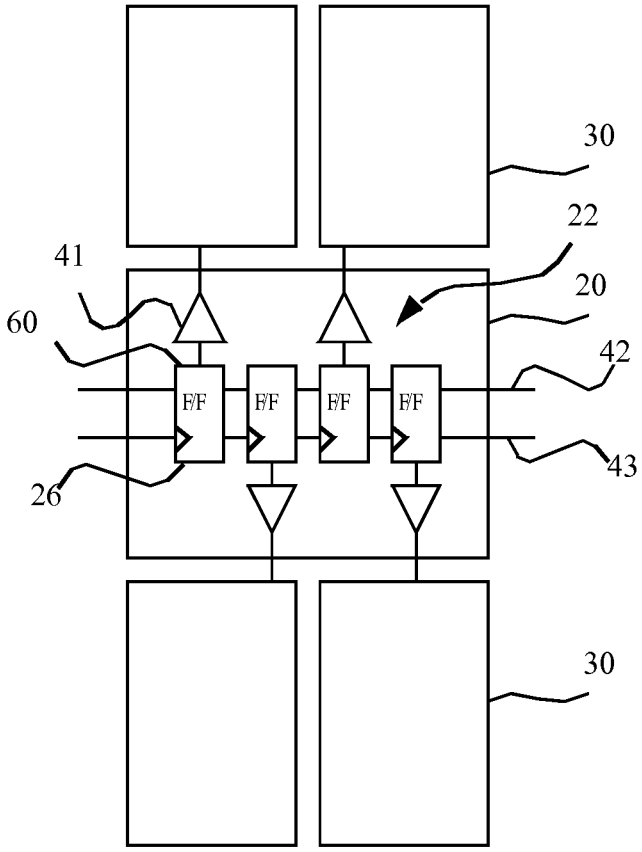
FIG. 1 is a schematic illustrating the elements of a chiplet and four associated pixels according to an embodiment of the present invention.

Because the various layers and elements in the drawings have greatly different sizes, the drawings are not to scale.

DETAILED DESCRIPTION OF THE INVENTION

Figure 2:
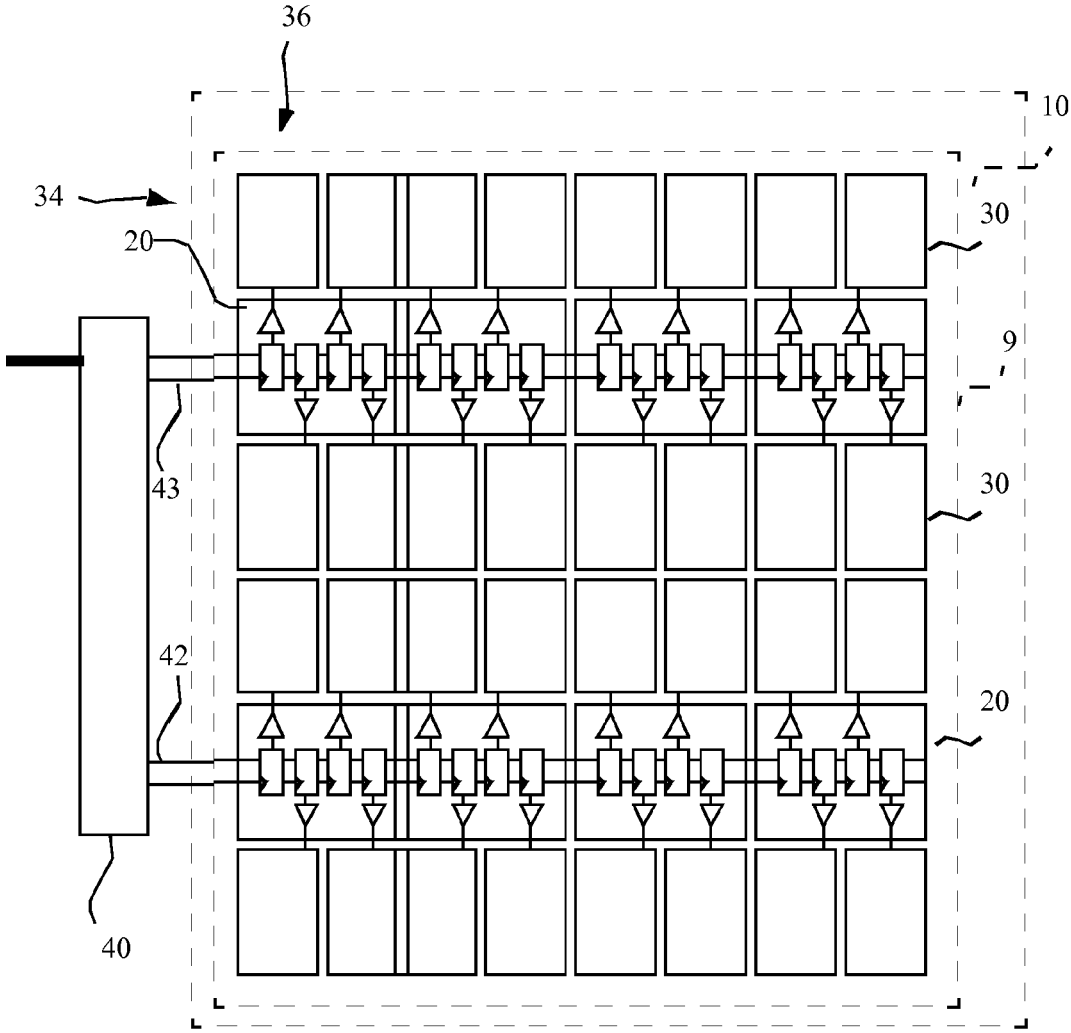
FIG. 2 is a schematic of an array of pixels in a display device with a driver according to an embodiment of the present invention.
Figure 3:
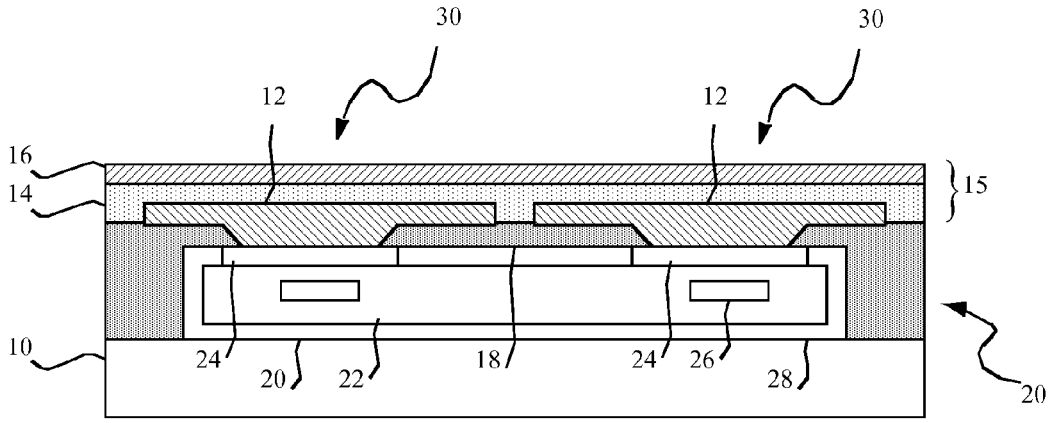
FIG. 3 is a cross section of a chiplet and pixel according to an embodiment of the present invention.

Referring to FIGS. 1, 2, and 3 in one embodiment of the present invention, a display device includes a substrate 10 and an array of pixels 30 forming a light-emitting area 9 over the substrate 10, the array of pixels 30 arranged in rows 34 and columns 36 formed on the substrate 10. Referring to FIG. 3, each pixel 30 includes a first electrode 12, one or more layers of light-emitting or light-controlling material 14 located over the first electrode 12, and a second electrode 16 located over the one or more layers of light-emitting material 14. The layers 12, 14 and 16 include a pixel 30, for example an organic light-emitting diode 15, in the areas where all three layers 12, 14, 16 overlap and current can flow through the one or more layers of light-emitting or light-controlling material 14 from the electrodes 12, 16.

Figure 9:
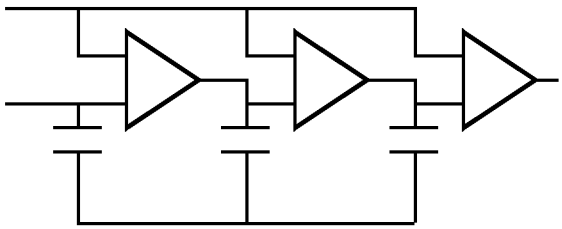
FIG. 9 is a schematic of a serially buffered analog signal according to an embodiment of the present invention.
Figure 4:
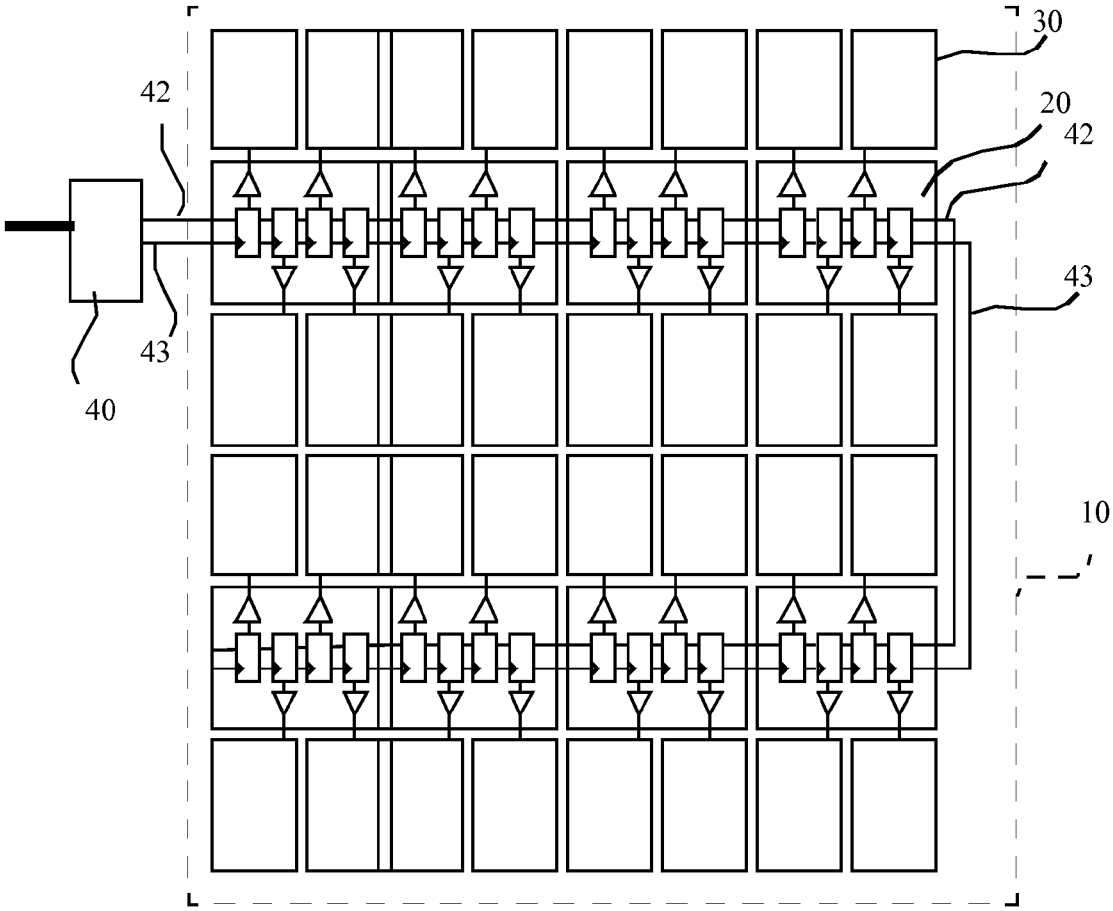
FIG. 4 is a schematic of an array of pixels in a display device with a serial connection for multiple rows according to an embodiment of the present invention.

A first serial buss 42 has a plurality of electrical conductors, each electrical conductor connecting one chiplet 20 in a first set of chiplets to only one other chiplet 20 in the first set in a serial connection. The plurality of serially-connected chiplets 20 are distributed over the surface of the substrate 10 in the light-emitting area 9, each chiplet 20 including one or more store-and-forward circuits 26 serially connected to a serial buss 42. For example, the store-and-forward circuit 26 can be digital, for example a flip-flop 60 controlled by a clock 43. Alternatively as shown in FIG. 9, the store-and-forward circuit 26 can be analog, including a capacitor for storing charge and a controlled buffer or transistor circuit for passing the charge from one store-and-forward circuit 26 to the next. A pixel driver circuit 41 drives a pixel 30 with data stored in the store-and-forward circuit 26. The clock 43 can be a common signal connected in series to two or more chiplets 20. The chiplets 20 can be connected in rows or columns. Each row (or column) of chiplets can be connected to a different serial buss 42 (as shown in FIG. 2) driven by the same, or different drivers 40. Alternatively, as shown in FIG. 4, two or more different rows of chiplets 20 can be driven with the same serial buss 42 by serially connecting separate rows together on the substrate 10. As shown, alternating rows can be driven in alternating directions. Alternatively, all of the rows can be driven in the same direction (not shown). The one or more light-emitting layers can include organic materials and the electrodes and light-emitting layers can form an organic light-emitting diode. The data value stored in the store-and-forward circuits can represent a desired luminance for a pixel.

A serial buss is one in which data is re-transmitted from one circuit to the next on electrically separated electrical connections; a parallel buss is one in which data is simultaneously broadcast to all of the chiplets on an electrically common electrical connection. As shown in FIG. 1, a plurality of serially-connected, store-and forward circuits 26 can be included within a chiplet 20 and connected to the electrical connections of the serial bus 42 to form an independent set of store-and-forward circuits 26 on a single serial buss 42. Moreover, a plurality of serial busses 42 serially-connecting a plurality of chiplets 20 in a plurality of sets can be employed, as shown in FIG. 2. It is also possible to connect multiple serial busses 42 to a chiplet 20 and to include multiple, serially-connected sets of store-and-forward circuits 26 within one chiplet 20. As shown in FIG. 4, chiplets 20 can be arranged in a plurality of rows or columns. A serial buss 42 can serially connect the chiplets 20 in two or more rows. Alternatively, a serial buss 42 can serially connect the chiplets in two or more columns.

A serial buss connects a driving device (e.g. a controller 40) to a first store-and-forward circuit with an electrical conductor. Each store-and-forward circuit on the serial buss connects to the next store-and-forward circuit with an electrically independent electrical conductor, so that all of the electrical conductors can communicate different data from one store-and-forward circuit to the next at the same time, for example in response to a clock signal. The driving device provides a first data value and a control signal to the first store-and-forward circuit that enables the store-and-forward circuit to store the data value. Once the first store-and-forward circuit has stored the first data value, a second data value can be provided to the first store-and-forward circuit at the same time as the first store-and-forward circuit provides the first data value to a second store-and-forward circuit. The control signal (for example, a clock signal) can be provided to all of the store-and-forward signals together or can be propagated from one store-and-forward circuit to the next, much as the data value is propagated. The first store-and-forward circuit then stores the second data value while the second store-and-forward circuit stores the first data value. The process is then repeated with a third data value and a third store-and-forward circuit, and so on, so that data values are sequentially shifted from one store-and-forward circuit to the next. Each chiplet includes one or more store-and-forward circuits so that the data values are shifted from one chiplet to the next. In contrast, a parallel buss, as used herein, provides the same signal to every circuit (or chiplet) at the same time.

Referring back to FIG. 3, each chiplet 20 has a substrate 28 that is independent and separate from the display device substrate 10. As used herein, distributed over the substrate 10 means that the chiplets 20 are not located solely around the periphery of the pixel array but are located within the array of pixels, that is, beneath, above, or between pixels 30 in the light-emitting area. Each chiplet 20 includes circuitry 22, for example including the store-and-forward circuit 26 and pixel driver circuit 41 (FIG. 1). Connection pads 24 can be formed on the surface of the chiplets 20 to connect the chiplets to the pixels 30. Planarization layers 18 can be employed to assist in photolithographically forming electrical connections with the connection pads 24. Preferably, chiplet interconnection busses are formed in a single wiring layer at least partially above the chiplets 20.

Figure 5A:
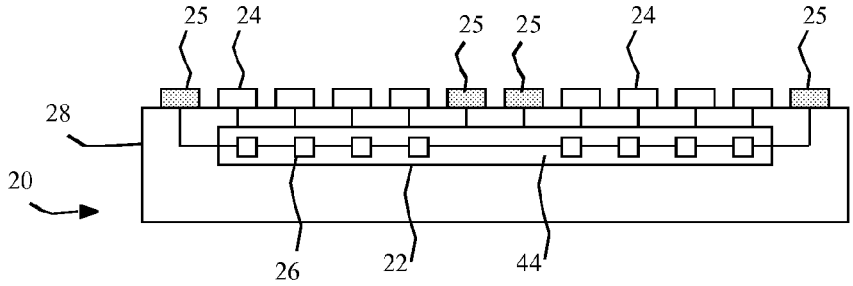
FIGS. 5A and 5B are cross sections of chiplets having internal connections according to alternative embodiments of the present invention.
Figure 5B:
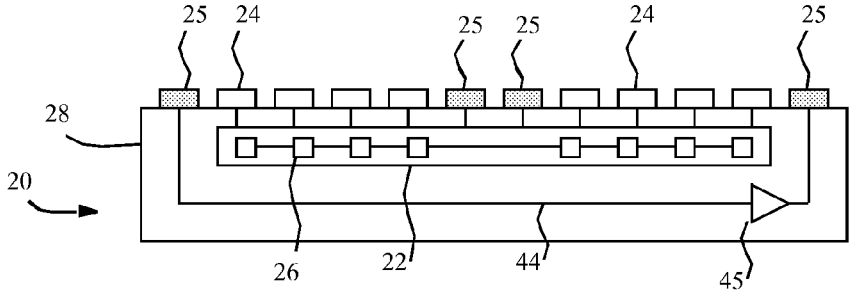

Referring to FIGS. 5A and 5B, the serial buss 42 and signal lines (e.g. clock line 43 or reset lines, not shown) can be connected to connection pads 25 on the chiplets 20. Internal chiplet connections 44 can be employed to connect each store-and forward circuit 26 to the next in a serial fashion, as shown in FIG. 5A. As shown in FIG. 5B, other signals (e.g. a clock or reset signal) can pass through the chiplet 20 from one connection pad 25 to another connection pad 25 and thereby connect all of the chiplets in parallel to a common signal. In one embodiment of the present invention, a buffer 45 can be employed to regenerate the common signal to overcome resistance in the busses, internal chiplet connections 44, or connection pads 25. The store-and-forward circuits 26 similarly regenerate the data signal passed from circuit to circuit.

Figure 6A:
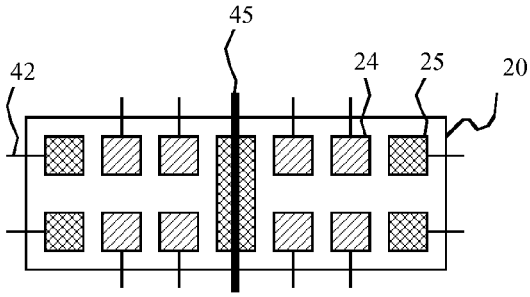
FIGS. 6A and 6B are top views of chiplets having various buss connections in alternative embodiments of the present invention.
Figure 6B:
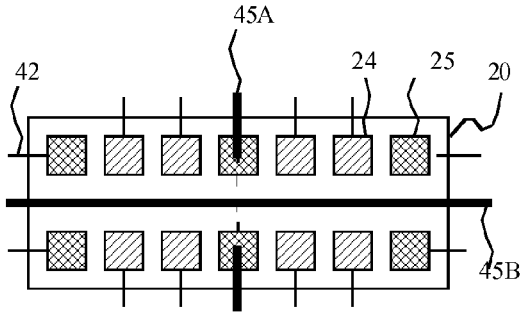

Referring to FIG. 6A, a serial buss 42 can pass through the chiplet 20 (as also shown in FIGS. 5A and 5B). Other busses 45 can be connected directly to circuitry within a chiplet 20 through a connection pad 25 without passing through the chiplet 20. Moreover, the buss 45 can be in a common wiring layer with the serial buss 42 since the serial buss 45, as shown, effectively passes over the serial buss 42 where the buss 42 passes through the chiplet 20. Alternatively, referring to FIG. 6B, a buss 45B can pass over buss 45A where the buss 45A is routed through the chiplet 20 in a fashion similar to that of the serial buss 42. By increasing the height of the chiplet 20, additional space can be provided for routing buss 45B parallel to the serial buss 42 and orthogonally to buss 45A. Again, such arrangements can be employed to provide a single, lower-cost wiring layer that interconnects the chiplets 20 over the substrate 10 to drive pixels 30 with signals provided on busses 42, 45, 45A, or 45B.

According to an alternative embodiment of the present invention, two serial busses that are connected to a common chiplet are associated and are employed to form a differential signal pair. A differential signal is one in which the difference between the voltage on two separate wires forms the signal. For example, if both wires have the same voltage, a zero value is indicated. If the wires have a different voltage, a one value is indicated. Such differential signals are more robust in the presence of interference since both wires are likely to experience the same interference and react in the same way. If the voltage of both wires is modified similarly, the differential signal is not changed.

In various embodiments of the present invention, the circuitry 22 can drive the pixels 30 with an active- or passive-matrix control scheme in each chiplet or combination of chiplets 20. For example, as shown in FIGS. 2 and 4, an active-matrix control scheme can be employed to independently control each pixel 30 through an individual pixel driver circuit 41. In this embodiment of the present invention, the first electrode 12 of each pixel is driven with an active-matrix circuit 22 in one chiplet 20 and the second electrode 16 of each pixel 30 is connected in common (for example as shown in FIGS. 1-4).

Figure 7:
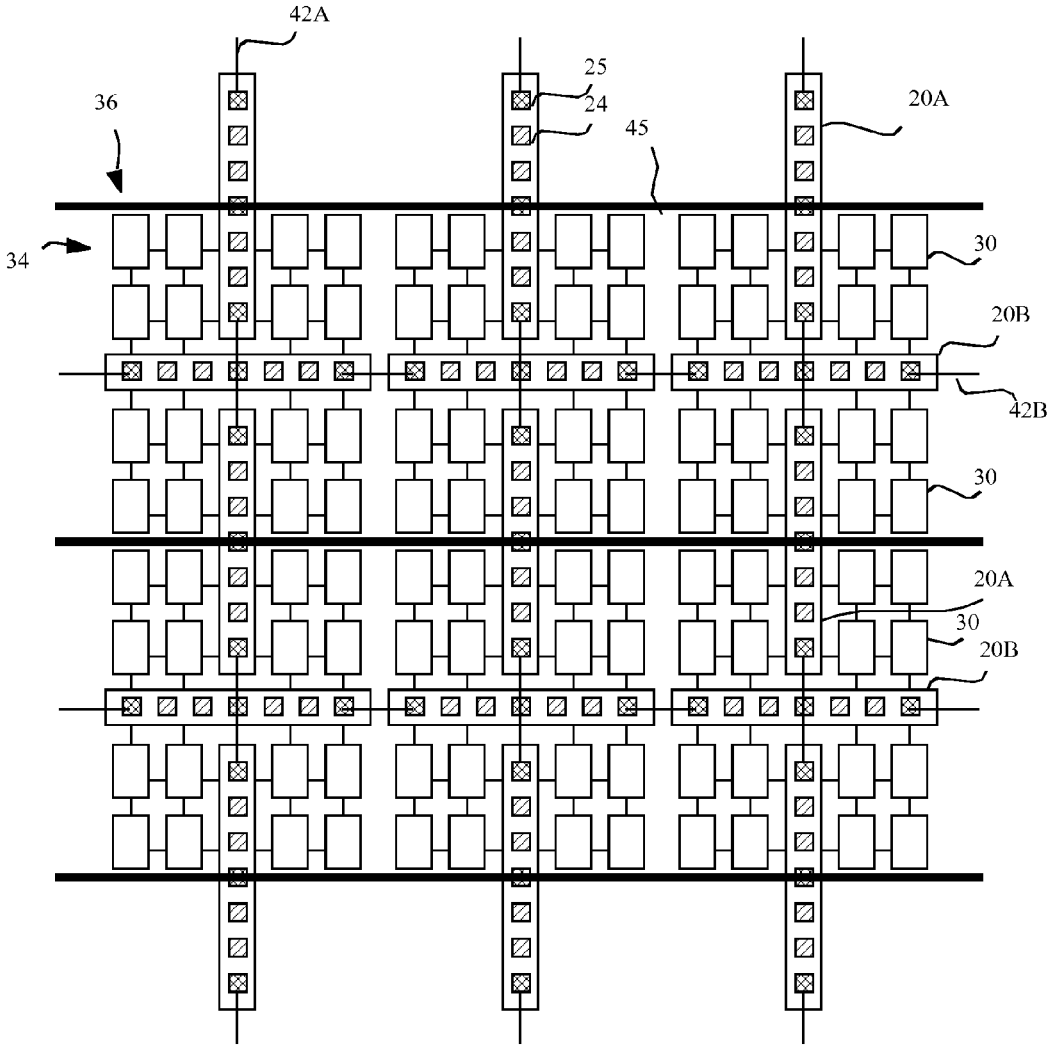
FIG. 7 is a partial schematic of a display device according to another embodiment of the present invention.

Referring to FIG. 7, in an alternative embodiment of the present invention, the first electrode 12 of each pixel 30 in a row of pixels 34 can be connected in common, the second electrode 16 of each pixel 30 in a column of pixels 36 can be connected in common, and the pixels 30 are driven with a passive-matrix control by two chiplets, a row driver chiplet 20A and a column driver chiplet 20B. The array of pixels 30 are subdivided into mutually exclusive pixel groups, i.e. each pixel group having a separate array of group row electrodes and a separate array of group column electrodes that are electrically independent from the group row electrodes and group column electrodes of any other pixel group. Each pixel group has one or more separate group row driver chiplets 20A and one or more separate group column driver chiplets 20B located over the substrate. Each group row driver chiplet 20A is exclusively connected to and controls pixel group row electrodes and each group column driver chiplet is exclusively connected to and controls pixel group column electrodes. As shown in FIG. 7, the group column driver chiplets are serially connected with buss 42B, the group row driver chiplets are serially connected with buss 42A, and the buss 45 is connected in parallel to the row driver chiplets. Generally, either a serial buss or an orthogonally-oriented buss passes through a chiplet and the other of the serial buss or orthogonally-oriented buss passes over or under the chiplet. Hence, one buss is routed over the substrate in a direction orthogonal to at least a portion of a serial buss and the serial busses (42A, 42B) and the orthogonal buss (45) are located in a common wiring layer over the substrate. This structure advantageously enables the busses 42A, 42B, and 45 to be routed in a single wiring layer. Furthermore, the data transmitted through the chiplet can be electrically regenerated with a buffer in the chiplet, thereby increasing the frequency at which the data can be transmitted through the serial buss.

Each chiplet 20 can include circuitry 22 for controlling the pixels 30 to which the chiplet 20 is connected through connection pads 24. The circuitry 22 can include storage circuits 26 that store a value representing a desired luminance for each pixel 30 to which the chiplet 20 is connected in a row or column, the chiplet 20 using such value to control either the row electrodes 16 or the column electrodes 12 connected to the pixel 30 to activate the pixel 30 to emit light. For example, if a row driver chiplet 20A is connected to 8 rows and a column driver chiplet is connected to 8 columns, eight storage circuits 26 can be employed to store luminance information for the 8 pixels connected to the row or column driver chiplet in one row or column. When a row or column is activated, luminance information can be supplied to the corresponding chiplet 20. In one embodiment of the present invention, two storage circuits 26 can be employed for each row or column connected to a chiplet, so that luminance information can be stored in one of the storage circuits 26 while the other storage circuit 26 is employed to display luminance information. In yet another embodiment of the present invention, one or two storage circuit 26 can be employed for each light-emitting element 30 to which the chiplet 20 is connected.

In operation, a controller 40 receives and processes an information signal according to the needs of the display device and transmits the processed signal through one or more serial busses 42 to each chiplet 20 in the device. The controller 40 can also provide additional control signals to the chiplets, routed through the same or separate busses as the processed signal. The processed signal includes luminance information for each light-emitting pixel element 30 corresponding to one of the store-and-forward circuits 26. The chiplets then activate the pixels according to the associated data value. Typically, an entire group row of electrodes or group column of electrodes within a pixel group is activated simultaneously by activating all of the group column electrodes and one row electrode at once (or vice versa). The busses 42, 45 can supply a variety of signals, including timing (e.g. clock) signals, data signals, select signals, power connections, or ground connections.

Conventional, matrix-addressed display devices, such as that of FIG. 8, require a two-dimensional array of signal connections. In contrast, according to the present invention, signal connections can advantageously be made in only one dimension, thereby improving the aperture ratio of the display and enabling simpler, lower-cost wiring structures with fewer via connections. Moreover, the rate at which data can be sent to the chiplets is at least as high as that of conventional methods, since the rate at which the chiplets can receive signals is as high as external row or column drivers (in the passive-matrix case), or higher (in the active-matrix case employing thin-film transistors). Moreover, the need for expensive external controlling driver integrated circuits is reduced, since not every row and column of the display device requires an individual driver circuit.

In various embodiments of the present invention, the row driver or column driver chiplets 20 distributed over the substrate 10 can be identical. However, a unique identifying value, i.e. an ID, can be associated with each chiplet 20. The ID can be assigned before or, preferably, after the chiplet 20 is located over the substrate 10 and the ID can reflect the relative position of the chiplet 20 on the substrate 10, that is, the ID can be an address. For example, the ID can be assigned by passing a count signal from one chiplet 20 to the next in a row or column. Separate row or column ID values can be used.

The controller 40 can be implemented as a chiplet and affixed to the substrate 10. The controller 40 can be located on the periphery of the substrate 10, or can be external to the substrate 10 and include a conventional integrated circuit.

According to various embodiments of the present invention, the chiplets 20 can be constructed in a variety of ways, for example with one or two rows of connection pads 24 along a long dimension of a chiplet 20 (FIGS. 7B, 7C). The interconnection busses 42 can be formed from various materials and use various methods for deposition on the device substrate. For example, the interconnection busses 42 can be metal, either evaporated or sputtered, for example aluminum or aluminum alloys. Alternatively, the interconnection busses can be made of cured conductive inks or metal oxides. In one cost-advantaged embodiment, the interconnection busses 42 are formed in a single layer.

The present invention is particularly useful for multi-pixel device embodiments employing a large device substrate, e.g. glass, plastic, or foil, with a plurality of chiplets 20 arranged in a regular arrangement over the device substrate 10. Each chiplet 20 can control a plurality of pixels 30 formed over the device substrate 10 according to the circuitry in the chiplet 20 and in response to control signals. Individual pixel groups or multiple pixel groups can be located on tiled elements, which can be assembled to form the entire display.

According to the present invention, chiplets 20 provide distributed pixel control elements over a substrate 10. A chiplet 20 is a relatively small integrated circuit compared to the device substrate 10 and includes a circuit 22 including wires, connection pads, passive components such as resistors or capacitors, or active components such as transistors or diodes, formed on an independent substrate 28. Chiplets 20 are separately manufactured from the display substrate 10 and then applied to the display substrate 10. The chiplets 20 are preferably manufactured using silicon or silicon on insulator (SOI) wafers using known processes for fabricating semiconductor devices. Each chiplet 20 is then separated prior to attachment to the device substrate 10. The crystalline base of each chiplet 20 can therefore be considered a substrate 28 separate from the device substrate 10 and over which the chiplet circuitry 22 is disposed. The plurality of chiplets 20 therefore has a corresponding plurality of substrates 28 separate from the device substrate 10 and each other. In particular, the independent substrates 28 are separate from the substrate 10 on which the pixels 30 are formed and the areas of the independent, chiplet substrates 28, taken together, are smaller than the device substrate 10. Chiplets 20 can have a crystalline substrate 28 to provide higher performance active components than are found in, for example, thin-film amorphous or polycrystalline silicon devices. Chiplets 20 can have a thickness preferably of 100 um or less, and more preferably 20 um or less. This facilitates formation of the adhesive and planarization material 18 over the chiplet 20 that can then be applied using conventional spin-coating techniques. According to one embodiment of the present invention, chiplets 20 formed on crystalline silicon substrates are arranged in a geometric array and adhered to a device substrate (e.g. 10) with adhesion or planarization materials. Connection pads 24 on the surface of the chiplets 20 are employed to connect each chiplet 20 to signal wires, power busses and row or column electrodes (16, 12) to drive pixels 30. Chiplets 20 can control at least four pixels 30.

Since the chiplets 20 are formed in a semiconductor substrate, the circuitry of the chiplet can be formed using modern lithography tools. With such tools, feature sizes of 0.5 microns or less are readily available. For example, modern semiconductor fabrication lines can achieve line widths of 90 nm or 45 nm and can be employed in making the chiplets of the present invention. The chiplet 20, however, also requires connection pads 24 for making electrical connection to the wiring layer provided over the chiplets once assembled onto the display substrate 10. The connection pads 24 can be sized based on the feature size of the lithography tools used on the display substrate 10 (for example 5 um) and the alignment of the chiplets 20 to the wiring layer (for example ±5 um). Therefore, the connection pads 24 can be, for example, 15 um wide with 5 um spaces between the pads. This means that the pads will generally be significantly larger than the transistor circuitry formed in the chiplet 20.

The pads can generally be formed in a metallization layer on the chiplet over the transistors. It is desirable to make the chiplet with as small a surface area as possible to enable a low manufacturing cost.

By employing chiplets with independent substrates (e.g. comprising crystalline silicon) having circuitry with higher performance than circuits formed directly on the substrate (e.g. amorphous or polycrystalline silicon), a device with higher performance is provided. Since crystalline silicon has not only higher performance but also much smaller active elements (e.g. transistors), the circuitry size is much reduced. A useful chiplet can also be formed using micro-electro-mechanical (MEMS) structures, for example as described in "A novel use of MEMS switches in driving AMOLED", by Yoon, Lee, Yang, and Jang, Digest of Technical Papers of the Society for Information Display, 2008, 3.4, p. 13.

The device substrate 10 can include glass and the wiring layers made of evaporated or sputtered metal or metal alloys, e.g. aluminum or silver, formed over a planarization layer (e.g. resin) patterned with photolithographic techniques known in the art. The chiplets 20 can be formed using conventional techniques well established in the integrated circuit industry.

In embodiments of the present invention using differential signal pairs, the substrate can preferably be foil or another solid, electrically-conductive material, and the two serial busses forming a differential signal pair can be laid out in a differential microstrip configuration referenced to the substrate, as known in the electronics art. In displays using non-conductive substrates, the differential signal pair can preferentially be referenced to the second electrode, and routed so that no portion of the first electrode of any pixel is located between the second electrode and either serial buss in the differential pair. LVDS (EIA-644), RS-485 or other differential signalling standards known in the electronics art can be employed on the differential signal pairs. A balanced DC encoding such as 4b5b can be employed to format data transferred across the differential signal pair, as known in the art.

The present invention can be employed in devices having a multi-pixel infrastructure. In particular, the present invention can be practiced with LED devices, either organic or inorganic, and is particularly useful in information-display devices. In a preferred embodiment, the present invention is employed in a flat-panel OLED device composed of small-molecule or polymeric OLEDs as disclosed in, but not limited to U.S. Pat. No. 4,769,292 to Tang et al., and U.S. Pat. No. 5,061,569 to VanSlyke et al. Inorganic devices, for example, employing quantum dots formed in a polycrystalline semiconductor matrix (for example, as taught in U.S. Patent Application Publication No. 2007/0057263 by Kahen), and employing organic or inorganic charge-control layers, or hybrid organic/inorganic devices can be employed. Many combinations and variations of organic or inorganic light-emitting displays can be used to fabricate such a device, including active-matrix displays having either a top- or a bottom-emitter architecture.

The invention has been described in detail with particular reference to certain preferred embodiments thereof, but it should be understood that variations and modifications can be effected within the spirit and scope of the invention.

PARTS LIST

9 light-emitting area
10 substrate
12 column electrode
14 light-emissive material
15 light-emitting diode
16 row electrode
18 planarization layer
20 chiplet
20A, row driver chiplet
20B column driver chiplet
22 circuitry
24 connection pad
25 buss connection pad
26 store-and-forward circuit
28 chiplet substrate
30 pixel
31 control element
34 row of pixels
36 column of pixels
40 controller
41 pixel driver circuit
42, 42A, 42B serial buss
43 clock
44 internal chiplet connection
45, 45A, 45B buss
50 column driver integrated circuit
52 row driver integrated circuit
60 flip-flop

The invention claimed is:

1. A display device, comprising:

(a) a substrate;

(b) an array of pixels arranged in rows and columns forming a light-emitting area over the substrate, each pixel including a first electrode, one or more layers of light-emitting material located over the first electrode, and a second electrode located over the one or more layers of light-emitting material;

(c) a first serial buss having a plurality of electrical conductors, each electrical conductor connecting one chiplet in a first set of chiplets to only one other chiplet in the first set in a serial connection, the chiplets being distributed over the substrate in the light-emitting area, each chiplet including one or more store-and-forward circuits for storing and transferring data connected to its corresponding electrical conductor; and (d) a driver circuit in each chiplet for driving at least one pixel in response to data stored in the store-and-forward circuit.

2. The display device of claim 1, further comprising a controller providing a signal through an electrical conductor to a chiplet in the first set and wherein the signal is regenerated in that chiplet.

3. The display device of claim 1, further including an active-matrix circuit associated with each chiplet in the first set and wherein the first electrode of each pixel is driven by an active-matrix circuit and the second electrode of each pixel is electrically connected in common.

4. The display device of claim 1, further including a passive-matrix control circuit in each chiplet in the first set, and wherein the first electrode of each pixel in a row of pixels is electrically connected in common, the second electrode of each pixel in a column of pixels is connected in common, and the pixels are driven with the passive-matrix control.

5. The display device of claim 1, wherein the store-and-forward circuit is a digital circuit.

6. The display device of claim 5, wherein the digital circuit includes flip-flops storing digital values.

7. The display device of claim 1, wherein the store-and-forward circuit is an analog circuit.

8. The display device of claim 7, wherein the analog circuit includes capacitors storing charge.

9. The display device of claim 1, further including a plurality of serial busses connected to a chiplet in the first set.

10. The display device of claim 1, further including a second set of chiplets connected to a second serial buss.

11. The display device of claim 1, wherein the chiplets are arranged in a plurality of rows or columns and the first serial buss serially connects the chiplets in two or more rows or serially connects the chiplets in two or more columns.

12. The display device of claim 1, wherein the chiplets are arranged in a plurality of rows and columns and the first serial buss serially connects the chiplets in a row and in a column.

13. The display device of claim 1, wherein the one or more light-emitting layers including organic materials and the electrodes and light-emitting layers form an organic light-emitting diode.

14. The display device of claim 1, wherein the array of pixels is subdivided into mutually exclusive pixel groups, each pixel group having a separate array of group row electrodes and a separate array of group column electrodes that are electrically independent from the group row electrodes and group column electrodes of any other pixel group; and wherein each pixel group has one or more separate group row driver chiplets and one or more separate group column driver chiplets located over the substrate, each group row driver chiplet exclusively connected to and controlling pixel group row electrodes and each group column driver chiplet exclusively connected to and controlling pixel group column electrodes.

15. The display device of claim 14, wherein the group column driver chiplets or group row driver chiplets are serially connected.

16. The display device of claim 1, further comprising a third buss routed over the substrate in a direction different from the direction of the first serial buss and wherein the first serial buss and the third buss are located in a common wiring layer over the substrate.

17. The display device of claim 1 further comprising a third buss routed over the substrate in a direction different from the direction of the first serial buss and wherein the first serial buss passes through a chiplet in the first set and the third buss passes over or under the chiplet.

18. The display device of claim 1, wherein the data stored in the store-and-forward circuit represent a desired luminance for the pixel.

19. The display device of claim 1, wherein two associated serial busses connected to a common chiplet are employed to form a differential signal pair.

* * * * *